United States Patent [19]

Hall

[11] 4,019,766

[45] Apr. 26, 1977

[54] SETTING MEANS FOR DOORLOCK ASSEMBLIES

[76] Inventor: Andrew D. Hall, David's Hill Road, Bedford Hills, N.Y. 10507

[22] Filed: Oct. 20, 1975

[21] Appl. No.: 623,770

[52] U.S. Cl. ..... 292/350

[51] Int. Cl.[2] ..... E05C 19/00

[58] Field of Search ..... 85/1 SS; 339/272; 151/24; 292/350, 351

[56] References Cited

UNITED STATES PATENTS

| | | | |
|---|---|---|---|
| 15,367 | 7/1856 | Bliss | 292/350 |
| 251,988 | 1/1882 | Young | 292/350 |
| 361,323 | 4/1887 | Rochow | 292/350 |
| 1,310,213 | 7/1919 | Rixson | 292/350 X |
| 2,711,167 | 6/1955 | Rickard | 128/83 |
| 3,052,462 | 9/1962 | Butler | 269/249 |
| 3,403,901 | 10/1968 | Servadio | 269/243 |

FOREIGN PATENTS OR APPLICATIONS

| | | | |
|---|---|---|---|
| 944,040 | 11/1947 | France | 292/350 |
| 689,906 | 4/1953 | United Kingdom | 85/155 |

*Primary Examiner*—Richard E. Moore
*Attorney, Agent, or Firm*—Pennie & Edmonds

[57] ABSTRACT

A two-element setting member for securing a doorknob to the operating shaft of a doorlock assembly is provided. The setting member comprises a threaded member and a grooved engaging member rotatably mounted on the threaded member. The setting member is threadedly received in a tapped hole located in the doorknob and communicating with the shaft onto which the doorknob is threaded. The engaging member has a forward face which is grooved for engaging with either a flat side surface of the shaft or a corner of the shaft at a number of different angular positions.

12 Claims, 9 Drawing Figures

SETTING MEANS FOR DOORLOCK ASSEMBLIES

BACKGROUND OF THE INVENTION

With conventional doorlock assemblies, the doorknob is typically threaded onto a square operating shaft and the shank of the doorknob provided with a tapped hole into which a set screw is threaded. The set screw is adapted to be threaded into the tapped hole and set against either of the four flat side surfaces of the operating shaft to lock the doorknob against rotation on the shaft. In certain situations, the four positions at which the doorknob can be secured to the operating shaft are insufficient. For example, it may be that the setting of the set screw against one flat face of the operating shaft will position the doorknob too tightly against the door while backing the doorknob off to move the set screw to the next flat surface will provide a loose attachment. In such a situation the loose attachment must be used in order to permit the doorlock mechanism to open and close properly. In this position of the doorknob, the user simply accepts the fact that the loose connection of the doorknob is unavoidable if proper mechanical functioning of the lock is desired.

In another situation, the four position setting of conventional doorknobs has also been found to present actual operating problems. In particular, where the doorknob is other than circular in shape, it sometimes occurs that the most proper setting of the doorknob, as far as tightness of the door is concerned, positions the knob so that turning during opening and closing of the door is interfered with by the door jamb. For example, where the doorknob is in the shape of a handle extending laterally of the operating shaft, this type of interference is most likely to occur. In order to avoid it with the presently available doorlock assemblies, the handle must be set at a position where it extends away from the door jamb as much as possible. Obviously, this position may not be the best as far as tightness of the doorknob against the door; and it may be necessary to back the doorknob off more than one-quarter turn to prevent the interference with the door jamb. It will be evident that this may further add to the looseness with which the doorknob must be positioned in order to at least obtain proper opening and closing of the doorlock mechanism.

In addition to the above operating deficiencies of the conventional type of doorlock assembly, the limited positions in which the doorknob can be locked to the operating shaft may simply be aesthetically unpleasing. For example, the doorknob may have a configured pattern which should be rotated to a particular orientation for providing the most aesthetic appearance. With the square shaft and the four possible settings of the doorknob of conventional constructions, the particular desired positioning of the doorknob may not be readily possible.

SUMMARY OF THE INVENTION

In accordance with the present invention, the setscrew is replaced by a two-element setting member received within the normal tapped hole of the handle. The setting member comprises a threaded member and an engaging member rotatably mounted on the leading end of the threaded member. The threaded member urges the engaging member against the side surface of the shaft. The engaging member may be urged against any flat side surface of the shaft; and in the case where the shaft is square in cross-section, this allows the handle to be set at four angular positions. The engaging member also includes two locking grooves for engaging a square shaped operating shaft of the lock at 12 additional angular positions. The first of the grooves is formed by two symmetrical surfaces which are at right angles to each other and extend centrally across the forward face of the grooved member. This groove is adapted to receive and mate with any of the four corners of the operating shaft when the handle has been rotated on the shaft to locate the shaft corner at a position centered on the tapped hole through which the setting member moves, thereby adding four more angular positions at which the handle may be secured relative to the operating shaft. The other locking groove extends transversely to the first groove and is also composed of two flat surfaces which are at right angles to each other. However, this groove is offset from the center of the engaging member. This groove is likewise configured to receive and mate with any corner of the operating shaft when the handle is angularly positioned with the corner of the shaft at a position intermediate the center of the tapped hole and one of its diametrically opposite edges. This adds eight more positions at which the handle may be secured, thereby resulting in a total of 16 possible positions.

DETAILED DESCRIPTION OF THE PREFERRED EMBODIMENT

Figure 1:
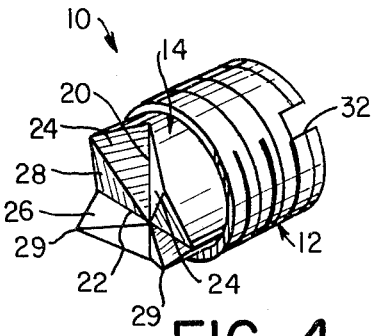
FIG. 1 is a perspective view of the two-element setting member of a doorlock assembly constructed in accordance with the teachings of the present invention.

A setting member constructed in accordance with the present invention is illustrated in FIGS. 1–4. The setting member 10 comprises two separable elements, a threaded member 12, and a grooved engaging member 14. Engaging member 14 includes a ball member 16 which mates with a socket 18 in the threaded member. The socket and ball member are centered with respect to the threaded and engaging members so as to be centered with respect to the longitudinal axis of the usual tapped hole of the doorknob into which the setting member is threaded.

Figure 2:
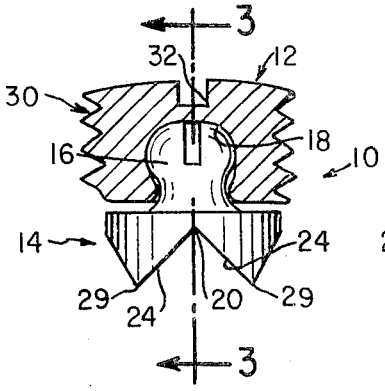
FIG. 2 is a cross-sectional view showing the two-element construction of the setting member.
Figure 3:
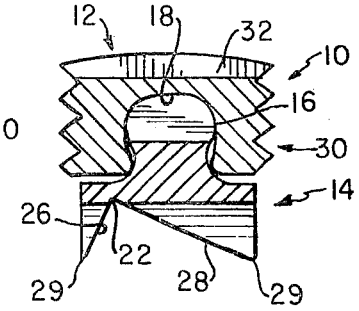
FIG. 3 is a view along lines 3—3 of FIG. 2.
Figure 4:
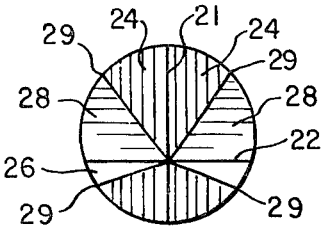
FIG. 4 is a plan view of the forward face of the engaging element of the setting member.

As shown in FIG. 2, the ball member 16 is split at 17 to permit a snap fit into socket 18. With this construction, the engaging member is easily attached to the threaded member; and it can also be removed when not desired, as more fully discussed below. When attached and when positioned in the tapped hole of the doorknob, the engaging member becomes rotatably mounted for rotation about the longitudinal axis of the tapped hole.

As also shown in FIG. 2, the neck of the ball member is smaller in size than the surrounding wall of the socket. This construction further provides a universal joint connection of the engaging member to the threaded member.

Engaging member 14 includes locking means in the form of two engaging grooves 20 and 22. Groove 20 is centrally positioned on the forward face of engaging member 14 with its center extending along the length of a diameter of the face. Groove 20 is defined by two planar surfaces 24 which extend at substantially right angles to each other. Groove 22 is positioned substantially perpendicular to groove 20 and is positioned between the center of the forward face of the engaging member and its edge. Groove 22 is also defined by a pair of planar surfaces 26 and 28 which extend at right angles with respect to one another.

The forwardmost surfaces of the engaging member, which are shown at 29, lie in a single plane which extends normal to the axis of rotation of the threaded member. This allows setting member 10 to be used in the same manner as the setscrew in a conventional doorlock assembly. More particularly, surfaces 29, which may be points or flats, are able to simultaneously engage a flat side surface of the operating shaft of the doorlock assembly.

Figure 5:
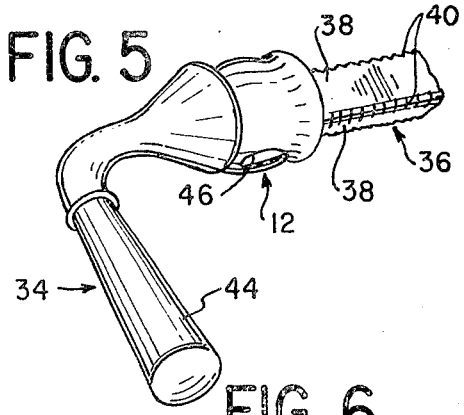
FIG. 5 is a perspective view of a doorknob locked in engagement with the operating shaft of a doorlock assembly by a setting member constructed in accordance with the present invention.

Referring to FIGS. 5–9, setting member 10 is used to lock doorknob 34 in a given angular relationship on the operating shaft 36 of a doorlock assembly. Operating shaft 36 includes a peripheral side surface defined by four flat side surfaces 38 meeting at corners. The corner surfaces themselves are provided with threads 40. Threads 40 mate with the threaded hole in the shank of the doorknob. Doorknob 34 comprises an actuating handle 44 extending laterally of the shank portion; and as illustrated in FIG. 5, the setting member 10 is screwed into tapped hole 46 to lock the doorknob to the operating shaft. Engaging member 14 has a diameter sufficiently small enough to allow it to advance through tapped hole 46 without being threaded. It is driven by threaded member 12 whose threads mate with the threads of tapped hole 46. Engaging member 14 is thus moved into contact with side surface of the shaft 36 by rotation of the threaded member.

Figure 7:
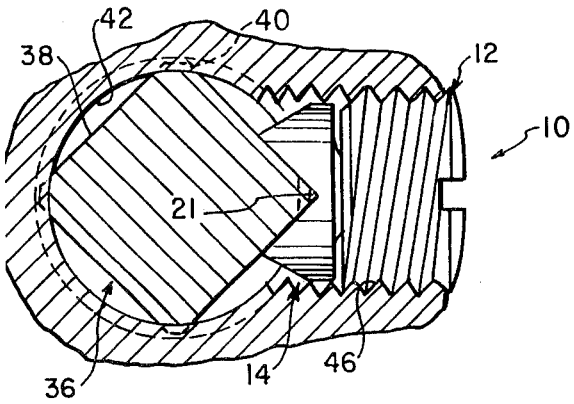
FIG. 7 shows the setting member secured at the same corner of the shaft as shown in FIG. 6 but at a second angular position.
Figure 6:
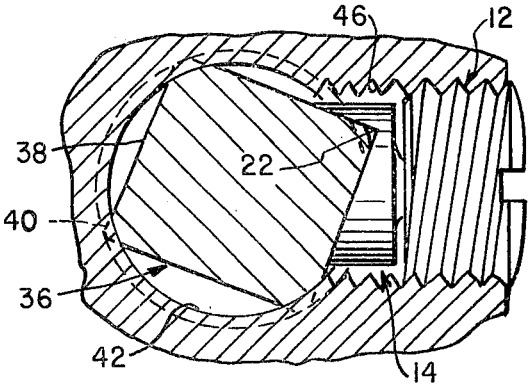
FIG. 6 is a cross-sectional view showing the setting member secured at a corner of the operating shaft of the doorlock assembly in a first angular position with respect to said shaft.
Figure 8:
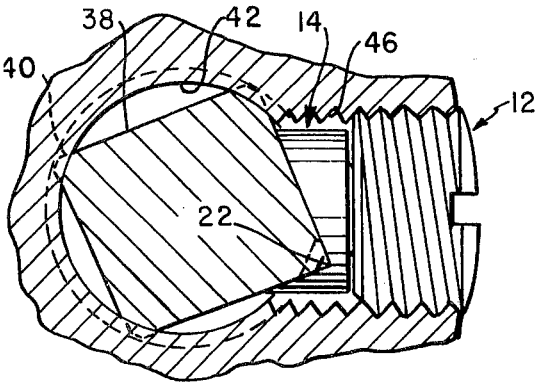
FIG. 8 shows the setting member secured at the same corner of the shaft as shown in FIG. 6 but at still another angular position.
Figure 9:
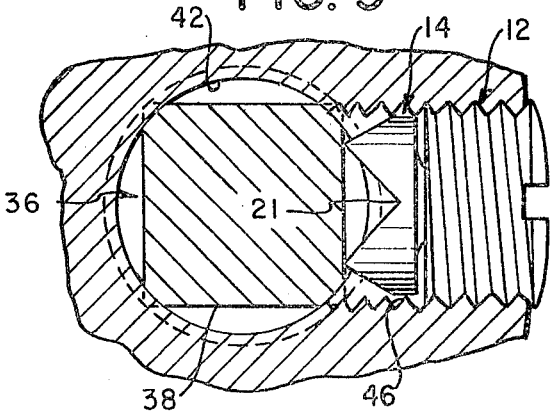
FIG. 9 is a view of the setting member in engagement with a flat side surface of the operating shaft of the doorlock assembly.

The engaging member can engage and lock the doorknob to the operating shaft of the doorlock assembly in 16 different angular positions, as illustrated in FIGS. 6–9. Each of the four illustrated positions correspond to four angular positions of handle 44 in which one of the flat side or corner surfaces of the shaft is engaged by the engaging member 14. Twelve of these positions correspond to engagement with the corner surfaces of the shaft when the corners are received within one of the grooves 20, 22 of the engaging member. In these positions, the engaged corner of the shaft faces into the tapped hole 46, either centrally thereof as shown in FIG. 7 (four positions, one for each corner) or adjacent one or the other side of the hole as shown in FIGS. 6 and 8 (another eight positions, two for each corner). Finally, another four positions are provided by the engagement of the engaging element with each of the four flat side surfaces 38, as is illustrated in FIG. 9. If this latter position of the shaft is desired, the engaging member 14 may be dispensed with and the threaded member 12 threaded into direct engagement with any of the flat surfaces 38 of the shaft.

I claim:

1. In a door handle mechanism having a threaded operating shaft with a polygonal cross-sectional shape, a handle threaded onto one end of the shaft, a tapped hole in said handle communicating with the peripheral side surface of the operating shaft, and setting means, including a threaded member, for threading into the tapped hole and into engagement with the peripheral side surface of the shaft to secure the handle on the shaft against rotation, the improvement in the setting means comprising:
   a. a shaft engaging member positioned at the leading end of the threaded member for engaging against the side surface of the shaft upon rotation of the threaded member into said tapped hole, said engaging member including:
      1. locking means for engaging against one of the corners of the side surface of the shaft for holding the handle against rotation with said corner facing into said tapped hole; and
   b. coupling means for rotatably attaching the shaft engaging member to said threaded member.

2. The improvement according to claim 1 wherein:
   a. said engaging member has a forward face facing the peripheral side surface of the operating shaft; and
   b. said locking means includes at least one groove extending across the forward face of the engaging member and adapted to receive a corner of the side surface of the shaft therein to lock the shaft against rotation.

3. The improvement according to claim 2 wherein:
   a. said groove extends across the center of the forward face of said engaging member to receive a corner of the side surface of said shaft when said corner is centered on said tapped hole.

4. The improvement according to claim 2 wherein:
   a. said groove is positioned on the forward face of said engaging member to receive a corner of the side surface of said shaft when said corner is facing into the tapped hole in a position between the center of the tapped hole and the edge thereof.

5. The improvement according to claim 2 including:
   a. a first groove extending across the center of the forward face of said engaging member for receiving a corner of the side surface of said shaft when said corner is centered on said tapped hole; and
   b. a second groove extending across the forward face of said engaging member at a location spaced from the center of the face, for receiving a corner of the side surface of said shaft when said corner is facing into the tapped hole in a position between the center of the tapped hole and the edge thereof.

6. The improvement according to claim 5 wherein:
   a. said shaft is square in cross-sectional shape; and
   b. each of said grooves is defined by two substantially planar surfaces which extend at right angles to each other.

7. The improvement according to claim 6 wherein:
   a. the grooved forward face of the engaging member terminates in forwardmost surfaces lying in a single plane extending perpendicular to the longitudinal axis of the tapped hole.

8. The improvement according to claim 7 wherein:

a. the forwardmost surfaces of the engaging member are adapted to engage against any flat side surface of the shaft to hold the handle against rotation with the engaged flat side surface of the shaft facing perpendicular to the longitudinal axis of the tapped hole.

9. The improvement according to claim 8 wherein:

a. said coupling means includes a ball and socket connection between the leading end of the threaded member and the rearward face of the engaging member.

10. The improvement according to claim 9 wherein:

a. said coupling means includes a socket in the leading end of the threaded member and a ball member fixed to the rearward face of the engaging member and extending into said socket; and b. the socket and ball member are located centrally of the tapped hole for rotatably attaching the engaging member to the threaded member for rotation about the longitudinal axis of the tapped hole.

11. The improvement according to claim 10 wherein:

a. the coupling means is a universal joint permitting universal pivoting movement of the attaching member relative to the threaded member.

12. In a door handle mechanism having a threaded operating shaft with a polygonal cross-sectional shape, a handle threaded onto one end of the shaft, a tapped hole in said handle communicating with the peripheral side surface of the operating shaft, and setting means, including a threaded member, for threading into the tapped hole and into engagement with the peripheral side surface of the shaft to secure the handle on the shaft against rotation, the improvement in the setting means comprising:

a. a shaft engaging member positioned at the leading end of the threaded member and having a forward face for engaging against the side surface of the shaft upon rotation of the threaded member into said tapped hole, said engaging member including:

1. locking means defined by at least two grooves for selectively engaging against one of the corners of the side surface of the shaft for holding the handle against rotation with said corner facing into said tapped hole, said grooves extending across the forward face of the engaging member and located at different positions relative to the center of said forward face and relative to each other for selectively receiving a corner of the side surface of the shaft at different rotative positions.

* * * * *